US010208595B2

(12) United States Patent
Kouhia et al.

(10) Patent No.: US 10,208,595 B2
(45) Date of Patent: Feb. 19, 2019

(54) ARRANGEMENT AND METHOD OF UTILIZING ROCK DRILLING INFORMATION

(71) Applicant: SANDVIK MINING AND CONSTRUCTION OY, Tampere (FI)

(72) Inventors: Anssi Kouhia, Tampere (FI); Jussi Puura, Pihtisulunkatu (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 45 days.

(21) Appl. No.: 15/105,772

(22) PCT Filed: Dec. 17, 2013

(86) PCT No.: PCT/EP2013/076847
§ 371 (c)(1),
(2) Date: Jun. 17, 2016

(87) PCT Pub. No.: WO2015/090362
PCT Pub. Date: Jun. 25, 2015

(65) Prior Publication Data
US 2017/0016325 A1 Jan. 19, 2017

(51) Int. Cl.

| | |
|---|---|
| ***E21C 39/00*** | (2006.01) |
| ***E21C 35/24*** | (2006.01) |
| ***E21D 9/00*** | (2006.01) |
| ***E21D 20/00*** | (2006.01) |
| ***E21B 7/02*** | (2006.01) |

(52) U.S. Cl.
CPC ..... *E21C 39/00* (2013.01); *E21B 7/025* (2013.01); *E21C 35/24* (2013.01); *E21D 9/006* (2013.01); *E21D 20/003* (2013.01)

(58) Field of Classification Search
CPC ..... E21C 35/24; E21C 41/16; E21C 39/00; E21B 7/025; E21B 7/022; E21D 9/003; E21D 20/003; E21D 20/006
USPC ..... 299/1.05, 1.1, 1.4, 1.7, 11, 12, 30; 175/24, 40, 50; 702/9
See application file for complete search history.

(56) References Cited

U.S. PATENT DOCUMENTS 3,922,015 A 11/1975 Poundstone
2003/0052529 A1 3/2003 Hakkinen
(Continued)

FOREIGN PATENT DOCUMENTS

WO 2006078198 A1 7/2006

OTHER PUBLICATIONS

Kanflod, Morgan: "Know what lies ahead with Tunnel Manager (TM)", Nov. 15, 2008, XPO55141715, Retrieved from the Internet: URL:https://web.archive.org/web/20081115102227/http://www.atlastcopco.com/us/Nws/ProductNews/070423_Know_what_lies_ahead_with_Tunnel_Manager.asp [retrieved on Sep. 22, 2014].
(Continued)

*Primary Examiner* — Carib A Oquendo
(74) *Attorney, Agent, or Firm* — Corinne R. Gorski

(57) ABSTRACT

An arrangement and method of utilizing rock drilling information in a mine whereby drill holes are drilled in a surrounding rock material by a first mining vehicle. During drilling measuring data is produced and is inputted to a monitoring device for analyzing procedures. The monitoring device produces rock condition data of the rock material being drilled. The produced rock condition data is then implemented in a second mining vehicle.

16 Claims, 7 Drawing Sheets

(56) References Cited

U.S. PATENT DOCUMENTS

| | | | | |
|---|---|---|---|---|
| 2008/0085161 | A1* | 4/2008 | Oberg | E21D 20/00 405/259.1 |
| 2010/0086359 | A1* | 4/2010 | Saleniemi | E21B 7/022 405/138 |
| 2010/0286965 | A1* | 11/2010 | Saleniemi | E21B 7/022 703/1 |
| 2011/0100711 | A1* | 5/2011 | Puura | E21B 7/022 175/24 |
| 2013/0080060 | A1* | 3/2013 | Yang | G01V 1/306 702/9 |

OTHER PUBLICATIONS

"Atlas Copco Technical specification-Measurement While Drilling", Feb. 2, 2009, XP055141719, Retrieved from the internet: URL:https://web.archive.org/web/20120812235824/http://www.atlastcopco.com/microsites/Images/Technicalspecification MWD_98512456 Ola_web_tcm533-2658058.pdf [retrieved on Sep. 22, 2014].

* cited by examiner

ARRANGEMENT AND METHOD OF UTILIZING ROCK DRILLING INFORMATION

RELATED APPLICATION DATA

This application is a § 371 National Stage Application of PCT International Application No. PCT/EP2013/076847 filed Dec. 17, 2013.

BACKGROUND OF THE INVENTION

The invention relates to an arrangement of utilizing rock drilling information.

The invention further relates to a method for gathering and utilizing information concerning rock drilling.

The field of the invention is defined more specifically in the preambles of the independent claims.

In mines underground rock spaces such as tunnels and storage halls are excavated. Development of the rock space requires drilling of drill holes to a surrounding rock material. After the development drilling several succeeding mine work procedures are performed in the same rock space. The development drilling may be monitored and data of the drilling may be gathered. However, utilization of the gathered drilling data is inefficient and cumbersome.

BRIEF DESCRIPTION OF THE INVENTION

An object of the invention is to provide a novel and improved arrangement and method for utilizing rock drilling information.

The arrangement according to the invention is characterized in that the monitoring device comprises at least one data processing device for analyzing the received measuring data of the rock drilling; the monitoring device is configured to produce at least one rock condition data of the rock material being affected by the rock drilling; the arrangement comprises at least one data transfer connection for transmitting the produced rock condition data from the monitoring device to at least one control unit of at least one second mining vehicle; and the produced rock condition data is configured to influence operation of the second mining vehicle.

The method according to the invention is characterized by producing in the monitoring device at least one rock condition data of the rock material being drilled; transmitting the produced rock condition data to at least one second mining vehicle; and controlling the operation of the second mining vehicle on the basis of the received rock condition data.

An idea of the disclosed solution is that the drill holes are drilled to a surrounding rock material by means of at least one first mining vehicle provided with at least one drilling machine. The first mining vehicle comprises measuring devices for producing measuring data during the drilling. The measuring data is input to one or more monitoring devices for being analyzed. The monitoring device is arranged to produce rock condition data of the rock material being drilled and the produced data is transmitted to one or more second mining vehicles for implementation. The operation of the second mining vehicle may be controlled of affected on the basis of the produced rock condition data.

An advantage of the disclosed solution is that the disclosed arrangement improves utilization of drilling data produced during the drilling procedure. Identified defects, changes and natural variations in the rock material may now be taken into account in the next process phases. Thus, efficiency and quality of the mining work may be improved.

According to an embodiment, the rock condition data also comprises position data. In other words, the produced rock condition data is bind or connected to the information relating to position of the drilling being measured. The first mining vehicle may be provided with position detection means allowing position of a rock drilling unit and a drilling tool to be determined. Position of a carrier of the first mining vehicle may be determined by means of any available position measuring devices and methods. Thus, the position detection may be based on measuring devices utilizing magnetic fields of the earth, for example. Further, position of the rock drilling machine and the tool relative to the carrier may be determined by means of sensors arranged in boom joints. The position data facilitates implementation of the rock condition data. The produced rock condition data may be retrieved and utilized when need be. The produced rock condition data may be identified by means of the included position data.

According to an embodiment, the rock condition data also comprises position data. The position data may comprise coordinates. A coordinate system of the mine may be utilized for defining position coordinates of the rock condition data. Alternatively, a coordinate system of an operating plan or a work site may be used.

According to an embodiment, the monitoring device comprises one or more processing devices for performing analyzing procedures and steps for the measuring data inputted or otherwise received by the monitoring device. The monitoring device may be a computer or may comprise several computers. One or more operating principles, control strategies, processing models and algorithms may be inputted or stored to the processor in order to control the operation of the monitoring device. The monitoring device is arranged to process the measuring data according to the set control strategies and is configured to produce one or more rock condition data or data elements. The produced rock condition data may be stored in one or more storage device or may be transmitted further away by means of one or more data transmission connections. The monitoring device may receive the measuring data through one or more input device or may retrieve the measuring data from one or more memory means. Further, in connection with the monitoring device may be one or more display devices.

According to an embodiment, the monitoring device is configured to produce rock condition data automatically. The monitoring device may operate autonomously, whereby the user or operator of the system does not need to give any specific control commands for the monitoring device for executing the analyzing procedure.

According to an embodiment, the rock condition data is produced in real-time. Thus, the measuring data is transmitted to the monitoring device, which executes an on-line processing and analyzes the received data without any delays. Thanks to this embodiment, updated rock condition data is always available.

According to an embodiment, producing the rock condition data is not produced in real-time, but instead delays may occur between the measurements, processing of the data and implementation of the produced rock condition data. The measuring results may be stored in one or more memory means. The monitoring device may retrieve the stored data later and perform the needed processing. The produced rock condition data may be stored in one or more storage device and may be retrieved later therefrom to be utilized in the control unit of the second mining vehicle. Thanks to this embodiment, the data transmission connection and network of the mine may be simpler as compared to a system based on on-line processing. The disclosed embodiment suits well in situations where the gathered drilling information and the produced rock condition data are utilized after few hours or days and no need for on-line results exists.

According to an embodiment, the second mining vehicle comprises at least one mine work device for affecting rock material. The operation of the mine work device of the second mining vehicle may be controlled according to the received rock condition data. Alternatively, the operation of the mine work device may be influenced on a basis of the rock condition data in other ways. It may be possible to change a pre-planned operation plan of the mine work device according to the rock condition data. Further, an estimate of performance of the mine work device may be updated based on the rock condition data.

According to an embodiment, the operation of the second mining vehicle may be controlled according to a plan, which may be pre-planned. The control unit receives the produced rock condition data, where after the rock condition data may be taken into account in the control of the operation. The plan may be modified on the basis of the rock condition data. The control unit of the second mining vehicle may modify or update the plan automatically as a response to receiving new rock condition data. Alternatively, the operator of the second mining vehicle may take into account the received rock condition data and may then modify the operating plan manually.

According to an embodiment, the operation of the second mining vehicle may be controlled according to a plan. Several operating plans may be pre-planned and stored. The plans may be stored in a memory storage device, which may be located in connection with the control unit of the second mining vehicle. The control unit receives the produced rock condition data, where after the rock condition data may be taken into account in the control of the operation. The plan to be implemented may be selected on the basis of the rock condition data. The operator of the second mining vehicle may consider the received rock condition data and may select the used operating plan manually. Alternatively, the control unit of the second mining vehicle may select the plan automatically in response to receiving new rock condition data.

According to an embodiment, the operation of the second mining vehicle may be controlled according to a plan. The control unit of the second mining vehicle may monitor the execution of the plan and may take the received rock condition data into account in the monitoring. The control unit may also produce an indication or warning when the monitoring indicates that the intended or executed plan cannot or should not be executed.

According to an embodiment, performance of the second mining vehicle is monitored. Performance of one or more mine work devices may be determined and monitored. The control unit of the second mining vehicle may estimate the performance and may determine time remaining for performing the current work task. The control unit may update the performance according to the received rock condition data and may also change the estimated remaining time of the current work task. Furthermore, the rock condition data may be taken into account when estimating performance and duration of execution of succeeding work tasks of the second mining vehicle.

According to an embodiment, the second mining vehicle comprises one or more display devices. The produced rock condition data may be visualized on the display device. Alternatively, or in addition to, the measuring data of the drilling may be visualized on the display device. The second mining vehicle may be manually controlled, whereby the operator makes the needed control decisions and gives control commands for controlling actuators. The visualization facilitates the work of the operator.

According to an embodiment, the arrangement comprises at least one data transfer connection for transmitting the produced rock condition data from the monitoring device to at least one second mining vehicle. A data transfer device may transmit the produced rock condition data directly from a first drill rig to a second drill rig. Alternatively, the rock condition data may be transmitted indirectly via one or more servers. A further alternative solution for the data transfer connection is that a data storage element or device, such as a memory stick or hard disk, is utilized for transmitting or transporting the data between the associate devices. However, the arrangement may comprise one or more data transfer connections.

According to an embodiment, the monitoring device is located on the first mining vehicle. Thus, the measuring data is transmitted from the one or more measuring devices to the monitoring device onboard the first mining vehicle. Between the measuring device and the monitoring device is one or more first data transfer connection. Then, the measuring data is analyzed and desired rock condition data is produced in the first mining vehicle. The produced rock condition data is transmitted via a second data transfer connection to the control unit of the second mining vehicle for being utilized therein.

According to an embodiment, the monitoring device is external to the first and second mining vehicles. Thus, the measuring data gathered in the first mining vehicle is transmitted via a first data transmission connection to one or more servers or computers, which are located in a control room, computer room or in some other suitable place outside an operating site. The external monitoring device analyzes the measuring data and produces the desired rock condition data, which is transmitted via a second data transmission connection to the control unit of the second mining vehicle for being utilized therein.

According to an embodiment, the monitoring device is located in the second mining vehicle. Thus, the measuring data gathered in the first mining device is transmitted via one or more first data transfer connection to the second mining vehicle. The onboard monitoring device of the second mining vehicle analyzes the measuring data of the rock drilling and produces desired rock condition data. Further, the produced rock condition data is transmitted via one or more second data transfer connection to a control unit of the second mining vehicle and is thereafter ready for utilization according to prevailing control principles.

According to an embodiment, the rock condition data comprises data on strength of the surrounding rock. Thus, the rock condition data may offer information for reinforcing work, for example. The information of the strength of the rock may also affect to charging of blasting holes and may indicate of ore and mineral contents of the rock material.

According to an embodiment, the rock condition data comprises data on fragmentation of the surrounding rock. Thus, the rock condition data may offer information for rock bolting, cable wire insertion and other reinforcing procedures.

According to an embodiment, the rock condition data comprises data on cracks in the surrounding rock. Thus, the rock condition data may offer information for rock bolting, cable wire insertion and other reinforcing procedures.

According to an embodiment, the rock condition data comprises data on risk of falling boulders created in the surrounding rock. The monitoring device may detect cracks and other discontinuity lines in the surrounding rock material and may estimate on the basis of the positions and directions of the discontinuity lines if a risk of falling boulders exists. This type of rock condition data may be used in the control of a rock bolting device, for example. The estimation of the falling boulder risk may include extrapolation and interpolation of the discontinuity lines in the surrounding rock material outside the formed underground space. When detected that two or more the discontinuity lines or discontinuity planes cross each other, the monitoring device may produce needed rock condition data for controlling the reinforcing operations.

According to an embodiment, the rock condition data comprises data on cavities of the surrounding rock. Position, size and even form of the detected cavity may also be determined. This type of rock condition data may prevent unnecessary charging of cavities, for example.

According to an embodiment, the rock condition data comprises data on ore or mineral type in the surrounding rock. Thanks to this embodiment production drilling may be directed more accurately and efficiency of the excavation process may be improved.

According to an embodiment, the rock condition data comprises data on ore or mineral content or grade in the surrounding rock. Thanks to this embodiment drilling plans may be modified and more efficient excavation may be executed.

According to an embodiment, the rock condition data comprises data on joints and faults in the surrounding rock. This type of rock condition data may be taken into account when performing reinforcing operations, and lining and finishing the surfaces of the underground spaces.

According to an embodiment, the rock condition data comprises data on rock mass classification. This type of rock condition data may be taken into account when designing the forthcoming production drilling and utilization of the excavated rock material.

According to an embodiment, the second mine vehicle comprises one or more mine work devices for affecting rock material of the mine. The mine work device of the second mining vehicle may be a rock drilling machine for drilling production drill holes to the surrounding rock material for detaching ore by a drilling and blasting method. The rock condition data may indicate position of the ore, for example. Based on the rock condition data direction, number and length of blasting holes may be determined.

According to an embodiment, the second mine vehicle comprises one or more mine work devices for affecting rock material of the mine. The mine work device of the second mining vehicle may be a charge inserting device. The charge inserting device may comprise a feed element for feeding charging material into the drill holes drilled by the first mining vehicle. The feed element may be a tubular element such as a hose or tube. The produced rock condition data may be used to determine strength and quality of the surrounding rock material, whereby strength of explosives can be determined. Thus, the rock condition data may be used to determine the amount of the charging material and type of the charges. If the rock condition data indicates that the rock material is fragmented, less charging strength may be needed. It is also possible to recognize changes in rock material type or ore and to adjust the charging according to that information. In addition to, the rock condition data may indicate that the surrounding rock material comprises a cavity through which the drill hole is drilled by the first mining vehicle. The cavity may be notified in the charge inserting so that feeding of unnecessary charging material into the cavity is avoided. Thanks to this, the cavity is not filled with extra charging material whereby safety is improved.

According to an embodiment, the second mine vehicle comprises one or more mine work devices for affecting rock material of the mine. The mine work device of the second mining vehicle may be a rock bolting device, which comprises a rock drilling machine for drilling reinforcing holes to the surrounding rock material. Additionally, the rock bolting device may comprise a mounting device or installation tool for inserting reinforcing bolts to the drilled reinforcing holes. The produced rock condition data may be used to determine a need for the reinforcement. The rock condition data may indicate that the surrounding rock material is fragmented or damaged in any other way and needs to be reinforced properly. The rock condition data may be used to determine number of the reinforcing holes, lengths and directions of the reinforcing holes and also distances between the reinforcing holes, for example. Further, the rock condition data may be used to determine what type of rock bolts are used to reinforce the rock material. Additionally, the monitoring system may detect if any risk of falling boulders occur in the underground spaces and based on that rock condition data the rock bolting device may be controlled to direct the reinforcing drill holes so that the reinforcing bolts are able to tie the boulder to the rock material around the boulder and to prevent it from falling.

According to an embodiment, the second mine vehicle comprises one or more mine work devices for affecting rock material of the mine. The mine work device of the second mining vehicle may be a cable wire inserting device, which comprises a rock drilling machine for drilling reinforcing holes to the surrounding rock material. The device further comprises a feed device for feeding a reinforcing cable into the reinforcing hole. In some reinforcing techniques a grouting material is fed to the reinforcing hole together with the cable. Thus, the cable wire inserting device may also comprise a grouting device for feeding the grouting material. However, when utilizing cable bolts which are provided with bottom anchoring system, the cable wire inserting device may be without any grouting device. The produced rock condition data may be used to determine a need for the reinforcement. The rock condition data may indicate that the surrounding rock material is fragmented and needs to be reinforced properly. The rock condition data may be used to determine number of the reinforcing holes, lengths and directions of the reinforcing holes and distances between the reinforcing holes, for example. Further, the rock condition data may be used to determine what type of grouting material is used and the amount of grouting material fed to each of the reinforcing holes. Additionally, it may be possible to feed grouting material only for limited longitudinal portions of the reinforcing holes on the basis of the rock condition data. This way, one or more limited portions of the reinforcing holes may be grout instead of the full length of the reinforcing hole.

According to an embodiment, the second mine vehicle comprises one or more mine work devices for affecting rock material of the mine. The mine work device of the second mining vehicle may be a reinforcing material feed device for feeding reinforcing fluid material into the drill holes drilled by the first mining vehicle. The produced rock condition data may be used to determine a need for reinforcing the surrounding rock material. Type of the reinforcing fluid being used, as well as amount of the fluid being fed may be decided on the basis of the rock condition data. It may also be possible to feed reinforcing fluid into the drilled reinforcing holes so that the reinforcing holes comprise different longitudinal portions having different reinforcing properties. If cracks or other defects are detected only in a limited longitudinal portion of the hole, it is possible to feed the reinforcing fluid only in that detected portion or the limited portion of the hole may be provided with a reinforcing fluid that is different than in other portions of the hole. Thus, reinforcing need and execution of the reinforcing may be determined on the basis of the rock condition data.

According to an embodiment, the second mine vehicle comprises one or more mine work devices for affecting rock material of the mine. The mine work device of the second mining vehicle may be a scaling device. The scaling device is for scaling loose rock material from a rock surface. Typically scaling is executed for walls and roofs of underground spaces in order to remove loose material and boulders, which may fall down and cause risks. The produced rock condition data may be used to determine properties of the rock surface of the excavated underground space. If detects are recognized on the rock surface, this information may be taken into account when determining a need for scaling, and when controlling the actual scaling operation.

According to an embodiment, the second mine vehicle comprises one or more mine work devices for affecting rock material of the mine. The mine work device of the second mining vehicle may be a shotcreting device. The shotcreting device is for lining walls and roofs of excavated underground spaces. The produced rock condition data may be used to determine properties of the rock surface of the excavated underground space. The rock condition data may also be used to determine a need for reinforcement of the surrounding rock surface and the surrounding rock material. Thickness of a shotcreting layer may be set according to the rock condition data, for example. Further, the rock condition data may have an impact in decisions concerning a choice of a used shotcreting material and implementing method of the shotcreting.

According to an embodiment, the first mining vehicle is a face drilling rig. The face drilling rig is also known as a mine development rig, since it is for development of underground tunnels, drifts, adits and underground spaces. The face drilling rig comprises drilling means for drilling blasting holes to a face of an underground space. The drilling means comprise at least one drilling boom and a drilling unit at a distal end of the drilling boom. The monitoring device is configured to produce at least one rock condition data of the rock material being drilled by the face drilling rig. The at least one second mining vehicle is arranged to execute mining work affecting the surrounding rock material of the underground space produced by the face drilling rig.

According to an embodiment, the monitoring device is configured to estimate position and direction of defects in the surrounding rock material of the underground space on the basis of the produced rock condition data. The defect may be a crack, joint, crevice, opening or fault detected in the surrounding rock material. The monitoring device may further comprise a control strategy to estimate directions of the detected cracks and other discontinuities. The relative positions of the detected discontinuity lines and their crossing may also be notified and included in the rock condition data. The estimation may include extrapolation and interpolation of the discontinuity lines in the surrounding rock material outside the formed underground space. The same applies also for detected discontinuity planes and surfaces.

According to an embodiment, the at least one second mining vehicle comprises at least one rock bolting device for arranging several reinforcing bolts in a bolting pattern. The bolting pattern may be fan-shaped comprising several drill holes in a row. The rock bolting device comprises a rock drilling machine for drilling several reinforcing holes to the surrounding rock material of a tunnel or any other underground space for forming a reinforcing drill hole pattern. The rock bolting device also comprises a mounting device for inserting the reinforcing bolts to the drilled reinforcing holes of the reinforcing drill hole pattern. The monitoring device is configured to observe detects in rock material surrounding the underground space. The second mining vehicle is configured to receive rock condition data and direct the reinforcing holes according to the observed detects. The observed detect may be a crack, for instance.

According to an embodiment, the second mining vehicle is configured to determine distance of successive reinforcing drill holes according to the observed detects. The observed defect may be a crack, for instance. The distance between the holes may be a distance between the holes in the drill hole row. Alternatively or in addition to, the rock condition data may be used to determine a distance between two successive drill hole rows. If the drill hole pattern has a shape of a fan, the distance between the successive fans may be determined on the basis of the rock condition data.

According to an embodiment, the second mining vehicle comprises at least one control unit for controlling the operation of the rock bolting device. The control unit of the second mining vehicle is arranged to control automatically the operation of a mine work device, such as a rock bolting device. The control unit takes automatically into account the produced rock condition data.

According to an embodiment, the second mining vehicle comprises at least one control unit for controlling the operation of a mine work device, such as a rock bolting device. The second mining vehicle is provided with one or more display devices and the control unit is configured to indicate the detected defects on the display device for an operator of the second mining vehicle. This embodiment offers intuitive visual information to be presented for the operator and thereby facilitates manual control of the second mining device.

According to an embodiment, the second mining vehicle comprises at least one control unit for controlling the operation of the rock bolting device. The control unit may take into account the received rock condition data and may automatically produce proposals for drilling the reinforcement drill holes and drill hole rows. Thanks to this embodiment, work of an operator is facilitated and loading of the work of the operator may be decreased.

The features, equipment, operating principles and methods disclosed in this patent application may be implemented in mines and other work sites. The mine may be any kind of an underground mine or a surface mine. Thus, the term mine is to be interpreted widely. The mentioned other work sites may comprise excavation sites, tunneling sites and road construction sites, for example.

The above disclosed embodiments can be combined in order to form suitable alternative solutions provided with necessary features.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
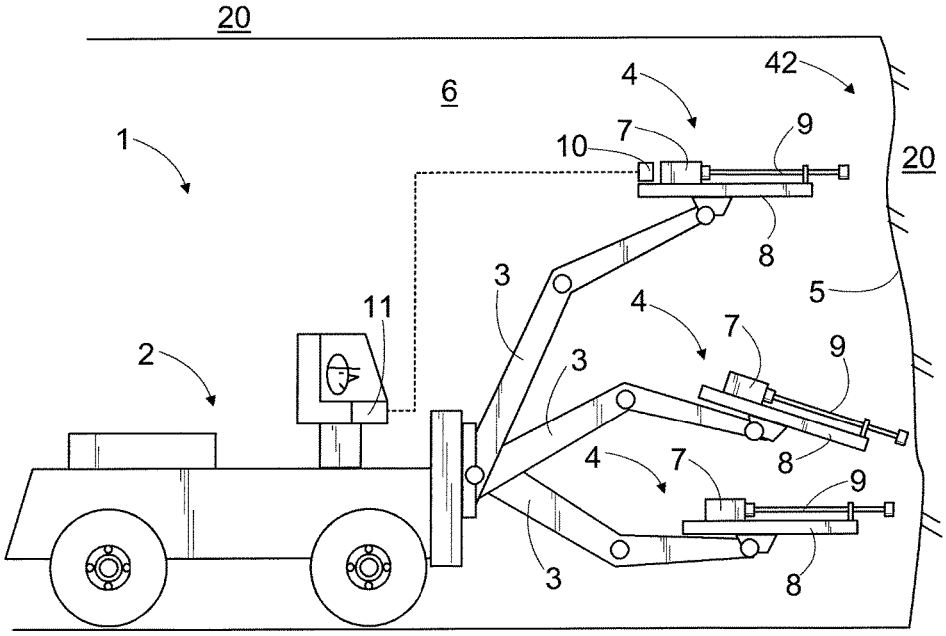
FIG. 1 is a schematic side view of a first mining vehicle comprising several drilling units.

FIG. 1 shows a first mining vehicle 1, which comprises a movable carrier 2 and one or more booms 3. The booms 3 may be provided with drilling units 4 for drilling holes to a rock surface 5 of a rock space 6. In FIG. 1 the first mining vehicle 1 is a face drilling rig which is used to drill blasting holes to a face 42 of an underground rock space 6. The drilling unit 4 comprises a rock drilling machine 7 arranged movably on a feed beam 8. The rock drilling machine may comprise a percussion device for generating impact pulses to a tool 9 and a rotating device for rotating the tool 9. The drilling unit 4 is provided with one or more sensors or measuring devices 10 for measuring the drilling operation. It is possible to measure percussion, rotation, feed and flushing, for example. By means of a so called measuring-while-drilling (MWD) valuable measuring data may de gathered for subsequent analysing processes. The measuring data may be transmitted to a control unit 11 of the first mining vehicle 1. Alternatively the measuring data may be stored in a memory unit in the drilling unit, or it may be send by means of a wireless data connection to an external control device.

Figure 2:
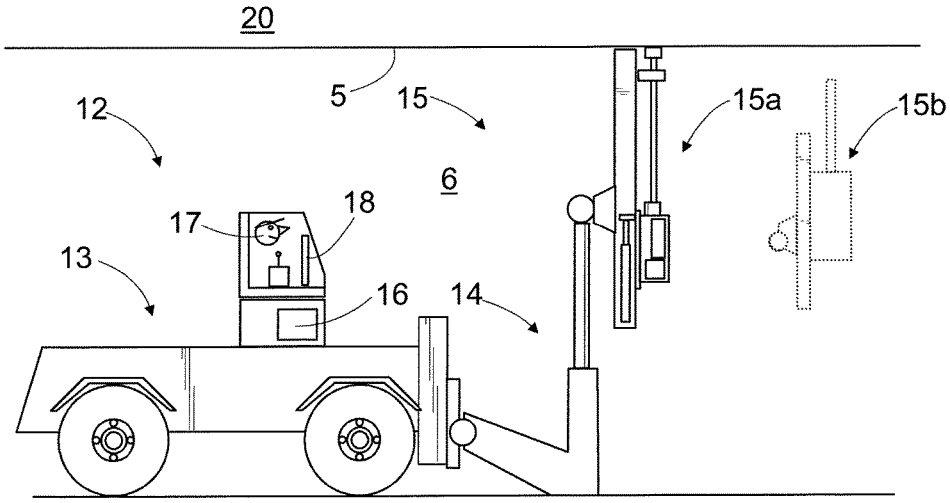
FIG. 2 is a schematic side view of a second mining vehicle comprising a rock bolting device.

FIG. 2 discloses a second mining vehicle 12, which is configured to utilize the measuring data gathered during operation of the first mining vehicle 1. The second mining vehicle 12 comprises a carrier 13 and one or more booms 14. The boom 14 is provided with at least one mine work device 15 for affecting rock material. In FIG. 2 the mine work device 15 is a rock bolting device 15*a* for arranging fastening bolts to the rock material 20 for supporting it. Alternatively, the mine work device 15 may be a feed device 15*b* for feeding a cable wire, grouting material or reinforcing fluid to a drill hole. The operation of the mine work device 15 influenced by the measuring data of the first mining vehicle 1 and produced rock condition data. MWD- and rock condition data may be transmitted or input to a control unit 16 of the second mining vehicle 12. The control unit 16 may provide visual information for the operator 17 on a display device 18 or the control unit 16 may select a suitable operating plan to be executed. The control unit may further predesign the operating plans on the basis of the rock condition data. It may also be possible that that the control unit 16 controls automatically the mine work device 15 so that the rock condition data is taken in to consideration.

FIGS. 1 and 2 disclose mine vehicles, which are used in underground mines. However, MWD-data may be gathered and utilized also in surface operating mine vehicles, such as surface drilling rigs.

Figure 3:
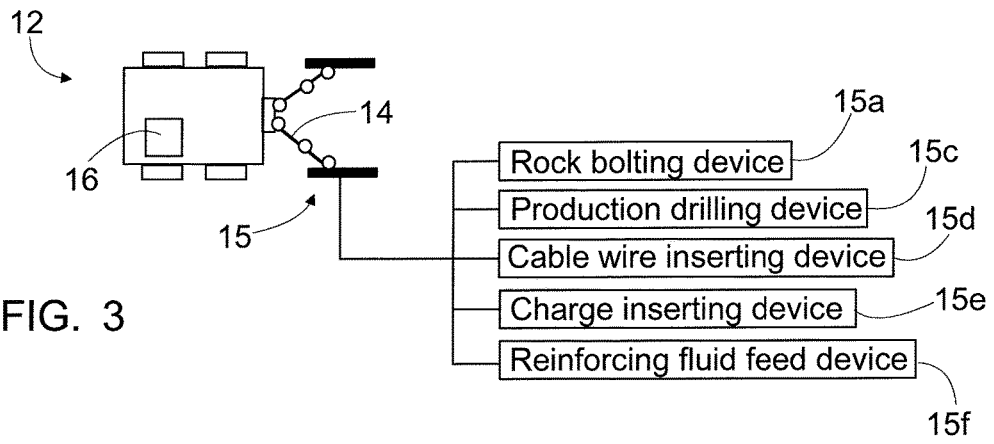
FIG. 3 is a schematic top view of a second mining vehicle and a list of feasible mine work devices.

FIG. 3 shows a second mining vehicle 12 and some possible mine work devices 15.

Figure 4:
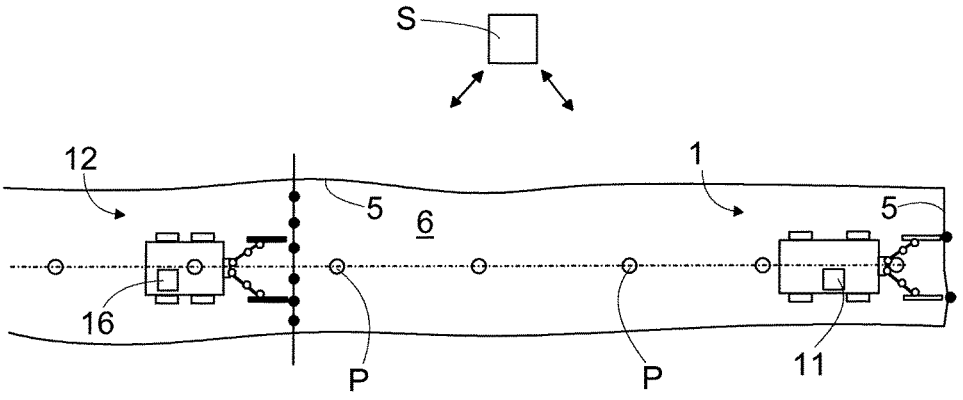
FIG. 4 is a schematic top view of a mine and operation of a first and second mine vehicle in the mine.

FIG. 4 illustrates the principle of producing and using the rock condition data. A first mining vehicle 1 performs drilling and gathers MWD-data which is analysed and thereafter utilized by a second mining vehicle 12. Based on the gathered measuring data rock condition data may be produced in a monitoring device, which may locate in connection with the control unit 11 of a first mining vehicle 1 or the control unit 16 of the second mining vehicle 12. In an alternative solution the monitoring device may be located external to the first and second mining vehicles. Thus, the monitoring device may locate in a server device S, for example. In FIG. 4 it is also demonstrated by means of simple position markings P that the measuring data gathered and the rock condition data produced may be connected to positioning data.

Figure 5:
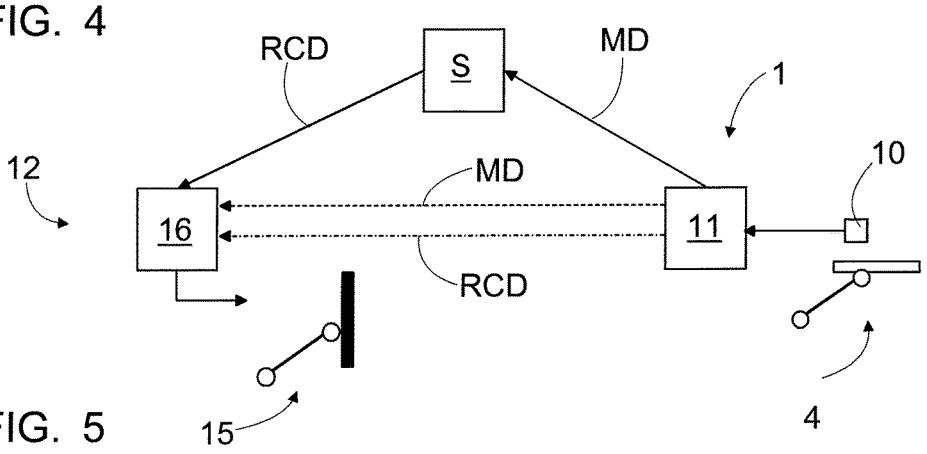
FIG. 5 is a schematic diagram showing feasible ways to transfer data between a first and second mining vehicle.

FIG. 5 shows, in a simplified manner, some possibilities to transfer data between the first mining vehicle 1 and the second mining vehicle 12. Measuring data MD may be transmitted or transported from the first mining vehicle 1 to a server S. Rock condition data RCD may be processed in the server S and may then be transmitted or transported to the second mining vehicle 12. In this case the monitoring device is located in the server S. Alternatively the monitoring device may be located in connection with the control units 11, 16 of the first and second mining vehicles 1, 12. The direct data transfers of MD and RCD are shown in FIG. 5 with dotted lines.

Figure 6:
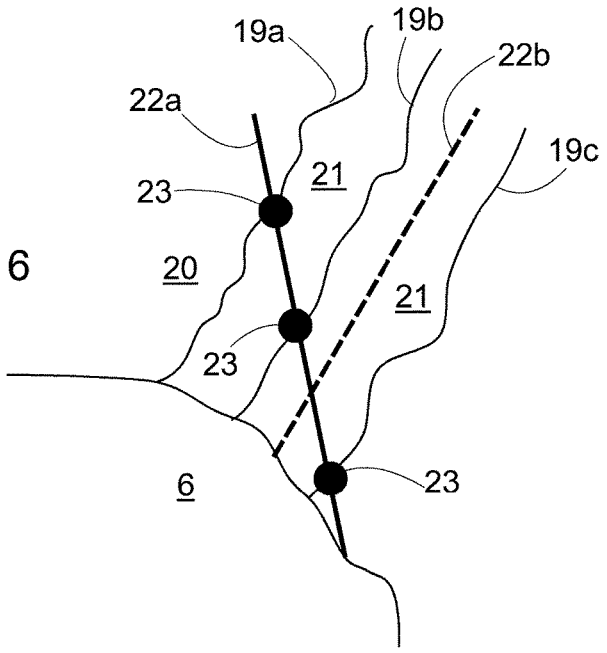
FIGS. 6, 7 and 8 are schematic views showing reinforcing of surrounding rock material by means of reinforcing rock bolts.

FIG. 6 shows cracks 19*a*-19*c* in a rock material 20 surrounding an excavated rock space 6. The cracks 19 define slabs 21 in the rock material 20. The slabs 21 of rock may slide or move in relation to each other in direction of the cracks 19. Rock bolts 22*a* are used to prevent this undesired movement between the slabs 21. However, in order to provide proper rock bolting it is important to know directions of the cracks 19. FIG. 6 shows a rock bolt 22*b*, which is in the direction of the cracks 19 and therefore fails to tie the slabs 21 together. The rock bolt 22*a* is directed in accordance of the rock condition data whereby the direction of the cracks 19 is determined and the rock bolt 22*a* is directed so that it crosses the cracks 19*a*-19*c* and connects the slabs 21 together. The rock bolt 22*b* is useless in this respect.

Figure 7:
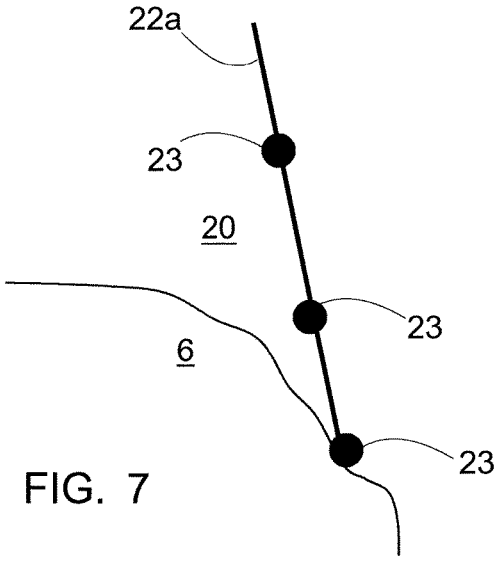
Figure 8:
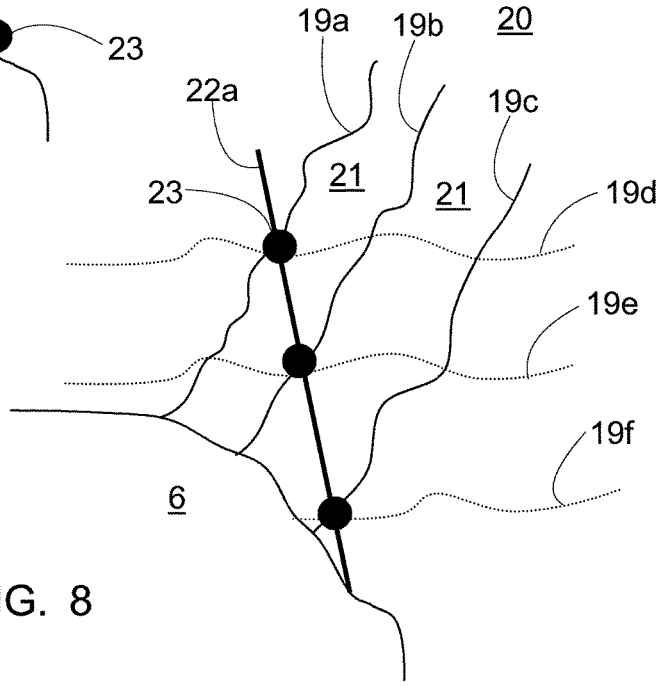
Figure 15:
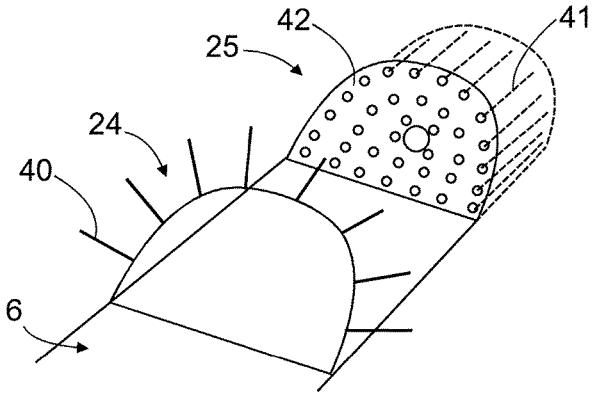
FIG. 15 is a schematic view showing a rock bolting pattern with only few drill holes, and a blast drill hole pattern of a face of a round provided with a great number of drill holes.

FIGS. 7 and 8 demonstrate that it is not sufficient to determine direction of the cracks only based on information gathered during drilling of a reinforcing hole for the rock bolt 22*a*. In FIG. 7 crossing points 23 between the cracks 19*a*-19*c* and the rock bolt 22*a* are shown. In FIG. 8 it is shown that instead of cracks 19*a*-19*c* the same crossing points 23 would be present for cracks 19*d*-19*f* having totally different directions as compared to directions of cracks 19*a*-19*c*. This means, that drilling of reinforcing holes for the rock bolts 22*a* does not provide enough information concerning the direction of the cracks 19 and the rock condition. However, when the rock space has been formed in a development drilling phase, a large amount of drill holes has been drilled to the rock material. During the development drilling an extensive measuring data amount may be gathered and when being analysed, more adequate rock condition data may be produced. In FIG. 15 it is illustrated that during reinforcing drilling 24 only 5 to 10 reinforcing holes 40 are drilled and during the development drilling 25 number of drill holes drilled to a face 42 of the rock space is substantially greater. There may be one hundred blasting holes 41 in the face 42 with short spacing. Thus, it is clear that the development drilling 25 produces more measuring data than the reinforcing drilling 24, whereby more sufficient and accurate analysis concerning the condition of the rock material may be processed.

Figure 9:
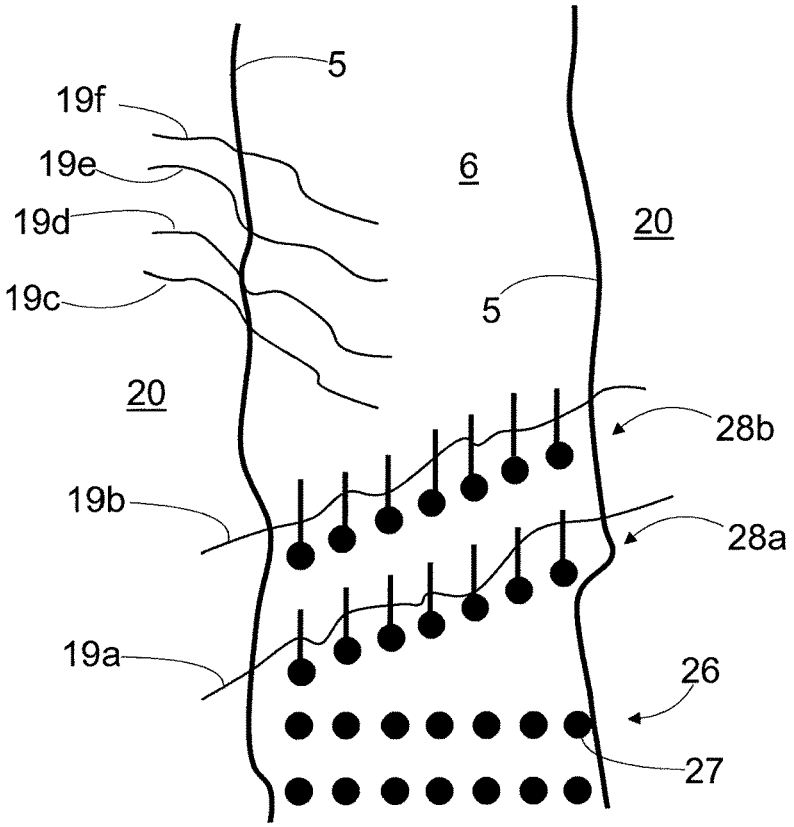
FIGS. 9 and 10 are schematic top views of rock spaces and corrective measures for reinforcing in accordance with the determined rock condition data.

FIG. 9 shows cracks 19*a* to 19*f* which are detected when measuring data of a development drilling phase of a rock space 6 is being analysed in a monitoring device. Directions of the cracks 19 are also determined and their continuation outside rock surfaces 5 of the rock space 6 is predicted in the monitoring device. Rock bolting patterns may be designed based on the produced rock condition data. Typically rock bolting patterns 26 are perpendicular to a centre line of a tunnel and comprise several reinforcing drill holes 27. However, modified rock bolting patterns 28*a* and 28*b* may be directed according to the detected direction of the cracks 19*a* and 19*b*. This way, the produced rock condition data is taken into consideration.

Figure 10:
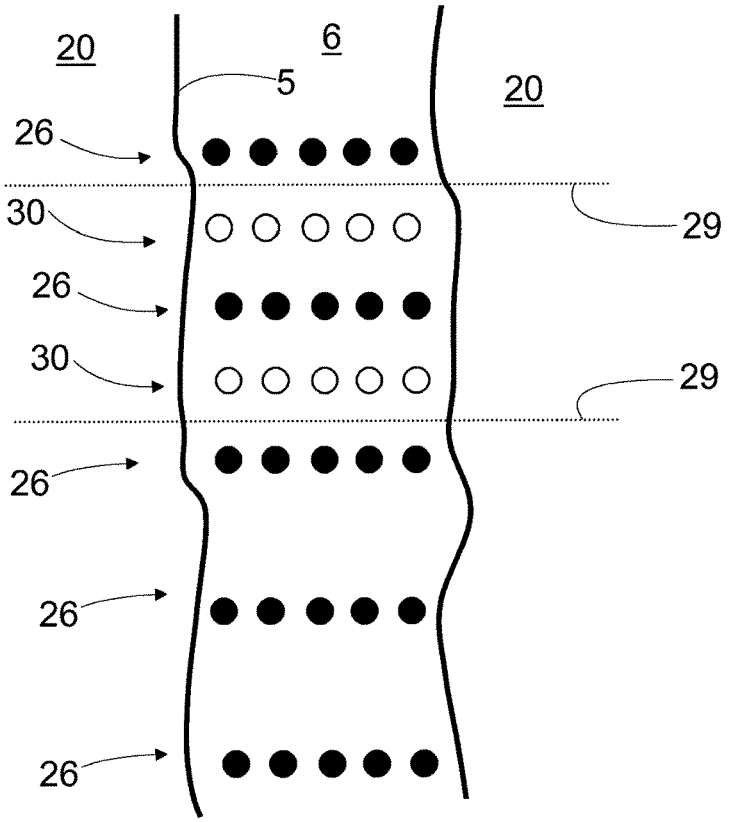

FIG. 10 shows predesigned rock bolting patterns 26 of a rock space 6. Between lines 29 rock quality is poor according to the rock condition data, wherefore additional rock bolting patterns 30 are designed for the detected portion to support a roof and ceilings of the rock space 6.

Figure 11:
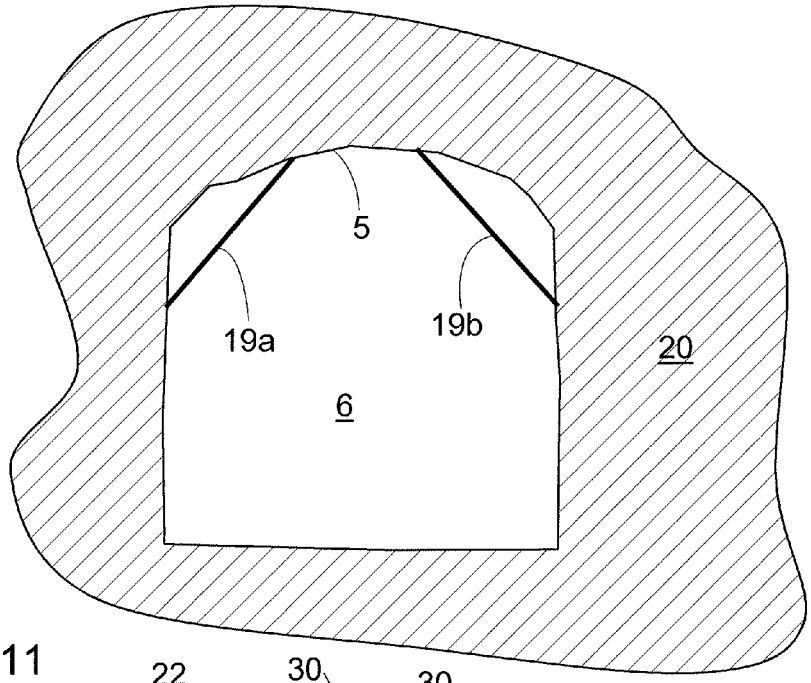
FIGS. 11 and 12 are schematic views showing detection of a risk of a falling bolder in a roof portion of a rock space and reinforcing measures.

FIG. 11 shows a tunnel or corresponding rock space 6 which is excavated to a rock material 20. During drilling of blasting holes measurements are executed and analysing process in a monitoring device indicates cracks 19*a* and 19*b* crossing the rock space 6. It may be predicted that the cracks 19*a* and 19*b* extend to the surrounding rock material 20 and that the detected discontinuity lines continue their detected direction.

Figure 12:
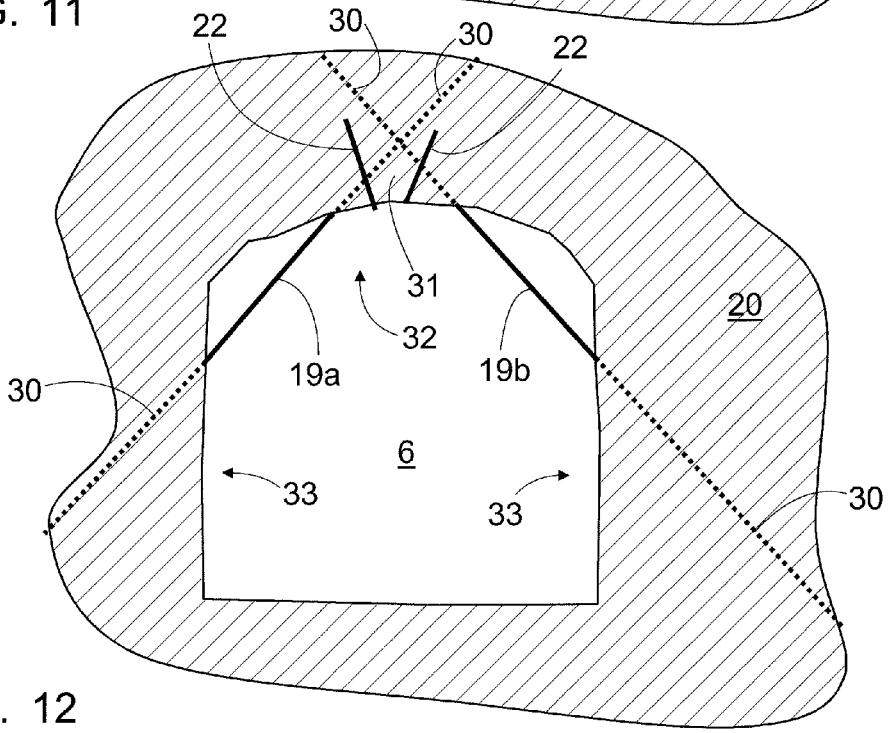

In FIG. 12 direction of the detected cracks 19*a* and 19*b* are estimated and the estimations 30 are shown using dotted lines. The estimation process may comprise extrapolation and interpolation algorithms input to the monitoring device. The monitoring device may detect if two or more estimated discontinuity lines 30 cross each other causing a risk of a falling boulder 31. In the shown example the falling boulder 31 is located in a roof 32 of the rock space 6 but it may be located also in walls 33. The produced rock condition data comprises information of the directions of the cracks 19 and detected position of the risk of the falling boulder 31. Based on the rock condition data rock bolts 22 may be directed and positioned so that a proper support is achieved. The rock condition data may also affect to the number of the rock bolts to be used.

Figure 13:
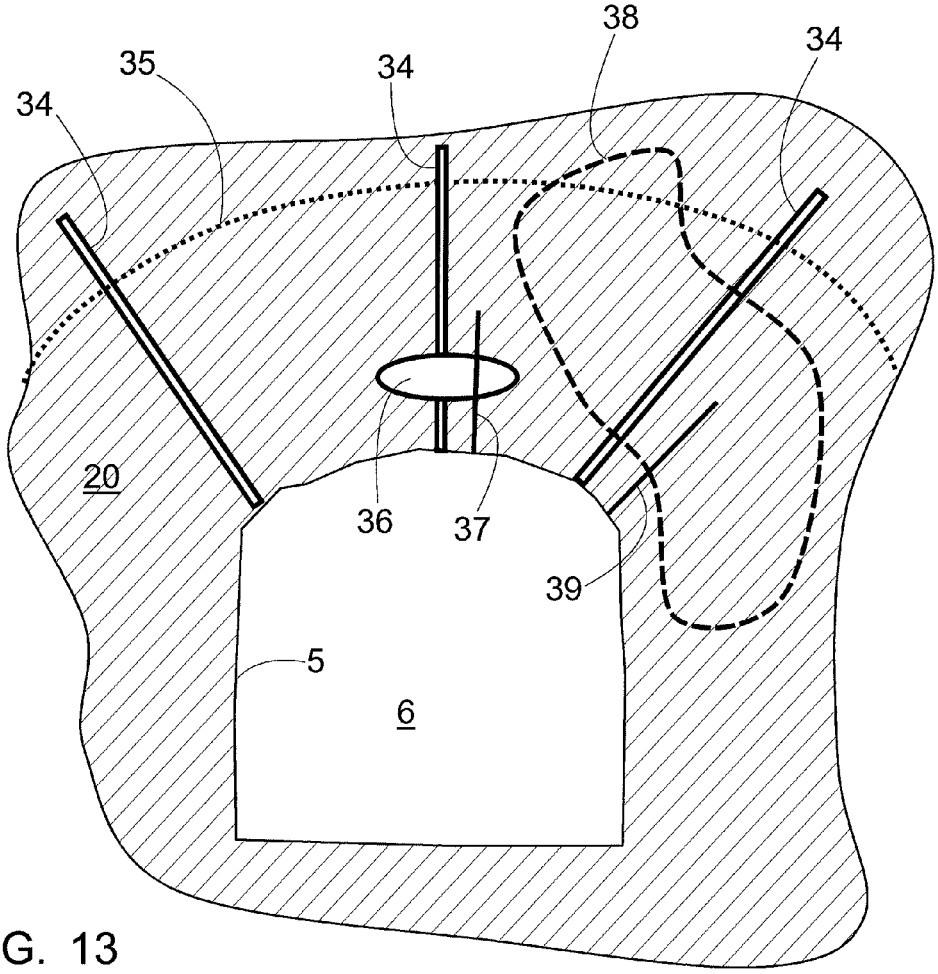
FIG. 13 is a schematic view showing a rock space and detected defects or discontinuities in a surrounding rock material.

FIG. 13 shows a rock space 6 and defects in the surrounding rock material 20. At first, the rock space 6 is developed using drilling and blasting method. During drilling of blast holes measuring in executed. In a second phase, long holes 34 extending outside of a predetermined production drilling are 35 are drilled and measuring data is gathered during the drilling. The long holes may be reinforcing holes or examination holes, for example. Analysing procedures of the measuring data may indicate that the surrounding rock material 20 comprises a cavity 36, which may be taken into consideration when feeding charging material through a charging drill hole 37. Thus, the produced rock condition data may avoid a risk of filling the cavity 36 with explosives. Further, it is possible to detect if the surrounding rock material 20 comprises areas 38 where ore or mineral type is different than elsewhere or where the quality of the rock is different. This rock condition data may be taken into consideration when drilling drill holes 39 extending to the detected area 38. Further, it is possible to influence to feeding of reinforcing material on the basis of the different portions the drill hole 39 passes through.

Figure 14:
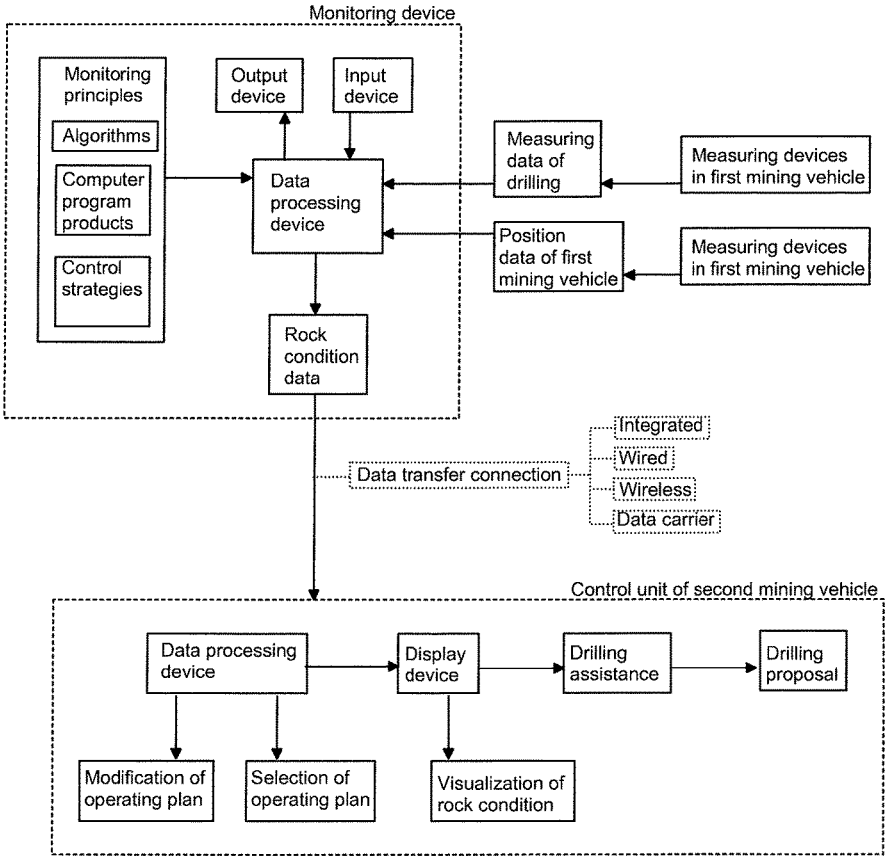
FIG. 14 is a schematic diagram showing some features of a monitoring device and the use of the created rock condition data.

FIG. 14 discloses features and operation of the monitoring device. These issues are already disclosed above in this application.

The drawings and the related description are only intended to illustrate the idea of the invention. In its details, the invention may vary within the scope of the claims.

The invention claimed is:

1. An arrangement for utilizing rock drilling information, wherein the arrangement comprises:

at least one first mining vehicle having at least one rock drilling machine for drilling drill holes in a surrounding rock material;

at least one measuring device disposed in the first mining vehicle arranged to produce measuring data of the rock drilling;

at least one monitoring device for monitoring the rock drilling based on measuring data received from the at least one measuring device, the at least one monitoring device being located in the first mining vehicle and including at least one data processing device for analyzing the received measuring data of the rock drilling, the at least one monitoring device in the first mining vehicle being configured to produce, in real-time, at least one rock condition data of the rock material being affected by the rock drilling; and at least one data transfer connection for transmitting the produced rock condition data from the monitoring device in the first mining vehicle to at least one control unit of at least one second mining vehicle, wherein the rock condition data produced at the first mining vehicle is configured to influence operation of the at least one second mining vehicle.

2. The arrangement as claimed in claim 1, wherein the second mining vehicle includes at least one mine work device for affecting rock material, the operation of the mine work device of the second mining vehicle being arranged to be influenced according to the received rock condition data.

3. The arrangement as claimed in claim 1, wherein the rock condition data includes data on joints and faults in the surrounding rock material.

4. The arrangement as claimed in claim 1, wherein the rock condition data includes data on cracks in the surrounding rock material.

5. The arrangement as claimed in claim 1, wherein the rock condition data includes data on fragmentation of the surrounding rock material.

6. The arrangement as claimed in claim 1, wherein the rock condition data includes data on cavities of the surrounding rock material.

7. The arrangement as claimed in claim 2, wherein the at least one mine work device of the second mining vehicle is a rock bolting device, which includes a rock drilling machine for drilling reinforcing holes in the surrounding rock material.

8. The arrangement as claimed in claim 2, wherein the at least one mine work device of the second mining vehicle is a rock drilling machine for drilling production drill holes in the surrounding rock material for detaching ore by a drilling and blasting method.

9. The arrangement as claimed in claim 2, wherein the at least one mine work device of the second mining vehicle is a reinforcing material feed device for feeding reinforcing fluid material into the drill holes drilled by the first mining vehicle.

10. The arrangement as claimed in claim 1, wherein the at least one first mining vehicle is a face drilling rig, the face drilling rig including drilling means for drilling blasting holes in a face of an underground rock space, the drilling means including at least one drilling boom and a drilling unit at a distal end of the drilling boom, the monitoring device of the first mining vehicle being configured to produce at least one rock condition data of the rock material being drilled by the face drilling rig, and the at least one second mining vehicle being arranged to execute mining work affecting the surrounding rock material of the underground rock space produced by the face drilling rig.

11. The arrangement as claimed in claim 10, wherein the monitoring device in the first mining vehicle is configured to estimate position and direction of defects in the surrounding rock material of the underground rock space based on the produced rock condition data.

12. The arrangement as claimed in claim 10, wherein the at least one second mining vehicle includes at least one rock bolting device for arranging several reinforcing bolts in a bolting pattern, the rock bolting device including a rock drilling machine for drilling several reinforcing holes in the surrounding rock material of the underground rock space for forming a reinforcing drill hole pattern, and a mounting device for inserting the reinforcing bolts to the drilled reinforcing holes of the reinforcing drill hole pattern, the monitoring device in the first vehicle being configured to observe deviations in rock material surrounding the underground rock space, and the second mining vehicle being configured to direct the reinforcing holes according to the observed defects.

13. The arrangement as claimed in claim 10, wherein the at least one second mining vehicle includes at least one rock bolting device for arranging several reinforcing bolts in a bolting pattern, the rock bolting device including a rock drilling machine for drilling several reinforcing holes to the surrounding rock material of the underground rock space for forming a reinforcing drill hole pattern, and a mounting device for inserting the reinforcing bolts to the drilled reinforcing holes of the reinforcing drill hole pattern, the monitoring device in the first mining vehicle being configured to observe deviations in rock material surrounding the underground rock space, and the second mining vehicle being configured to determine distance of successive reinforcing drill holes according to the observed defects.

14. The arrangement as claimed in claim 1, wherein the at least one second mining vehicle includes at least one rock bolting device and at least one control unit for controlling the operation of the rock bolting device, the second mining vehicle including at least one display device, and the control unit being configured to indicate the detected defects on the display device for an operator of the second mining vehicle.

15. The arrangement as claimed in claim 14, wherein the control unit is further arranged to show automatically a proposal for drilling the reinforcing drill holes.

16. A method of utilizing rock drilling information, the method comprising:

drilling drill holes in a rock material by at least one first mining vehicle provided with at least one drilling machine;

producing measuring data during the drilling;

gathering the produced measuring data;

inputting the measuring data to at least one monitoring device located in the at least one first mining vehicle;

monitoring the drilling on the basis of the measuring data in the monitoring device;

producing in the monitoring device located in the at least one first vehicle, in real-time, at least one rock condition data of the rock material being drilled;

transmitting the produced rock condition data from the at least one first vehicle to at least one second mining vehicle; and controlling the operation of the at least one second mining vehicle based on the rock condition data received from the at least one first vehicle.

* * * * *